US006594462B2

(12) United States Patent
Ishii et al.

(10) Patent No.: US 6,594,462 B2
(45) Date of Patent: Jul. 15, 2003

(54) DEVELOPING APPARATUS USING TONER WITH CONDUCTIVE PARTICLES

(75) Inventors: Yasuyuki Ishii, Mishima (JP); Tomomi Kakeshita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/803,968

(22) Filed: Mar. 13, 2001

(65) Prior Publication Data

US 2001/0048828 A1 Dec. 6, 2001

(30) Foreign Application Priority Data

Mar. 15, 2000 (JP) ..... 2000-072956

(51) Int. Cl.[7] ..... G03G 15/08
(52) U.S. Cl. ..... 399/281; 399/252
(58) Field of Search ..... 399/279, 281, 399/284, 285, 252; 430/108.6

(56) References Cited

U.S. PATENT DOCUMENTS

| | | | | | |
|---|---|---|---|---|---|
| 3,639,245 | A | * | 2/1972 | Nelson | 252/62.53 |
| 4,210,448 | A | * | 7/1980 | Forgo | 252/62.51 |
| 4,601,967 | A | * | 7/1986 | Suzuki et al. | 430/106.1 |
| 4,755,847 | A | * | 7/1988 | Matsushiro et al. | 399/284 |
| 5,202,211 | A | * | 4/1993 | Vercoulen et al. | 430/108.6 |
| 5,219,694 | A | * | 6/1993 | Anno et al. | 430/108.1 |
| 5,350,659 | A | * | 9/1994 | Lee et al. | 430/137.11 |
| 5,457,001 | A | * | 10/1995 | Van Ritter | 430/108.22 |
| 5,614,344 | A | * | 3/1997 | Kawakami et al. | 430/102 |
| 6,229,979 | B1 | | 5/2001 | Ishii et al. | 399/281 |

FOREIGN PATENT DOCUMENTS

| | | | | | |
|---|---|---|---|---|---|
| JP | 36-10231 | | | 7/1936 | |
| JP | 55048754 | A | * | 4/1980 | G03G/9/08 |
| JP | 59-53856 | | | 3/1984 | |
| JP | 59211050 | A | * | 11/1984 | G03G/13/09 |
| JP | 04101161 | A | * | 4/1992 | G03G/9/08 |
| JP | 10198078 | A | * | 7/1998 | G03G/9/113 |

* cited by examiner

*Primary Examiner*—Robert Beatty
(74) *Attorney, Agent, or Firm*—Fitzpatrick, Cella, Harper & Scinto

(57) ABSTRACT

A developing apparatus, which can obtain a stable toner charging amount even if a developer charging member is contaminated by toner and reduce reversal fog to reduce toner consumption, has a developer carrying body for carrying a developer to a developing position, and a developer charging member contacted with the developer to charge the developer, wherein the developer includes toner and conductive particles.

19 Claims, 11 Drawing Sheets

DEVELOPING APPARATUS USING TONER WITH CONDUCTIVE PARTICLES

BACKGROUND OF THE INVENTION

1. Field of the Invention

The present invention relates to a developing apparatus for forming a developer image by adhering developer to an electrostatic image formed on an image bearing body, which is suitable to be used with an image forming apparatus of electrophotographic type such as a copying machine, a printer, a facsimile and the like.

2. Related Background Art

As a developing apparatus used with an image forming apparatus of an electrophotographic type, various developing apparatuses have been proposed. For example, recently, there has been proposed a so-called nonmagnetic one-component DC contact developing system in which developing is effected by urging a semiconductive developing roller or a developing roller having a surface constituted by a dielectric layer against a surface layer of a photosensitive member.

FIG. 10 is a schematic constructural view showing an image forming apparatus (laser beam printer of an electrophotographic type) having a contact type one-component developing apparatus (referred to merely as "developing apparatus" hereinafter) for effecting development by a conventional nonmagnetic one-component DC contact developing system.

The image forming apparatus includes a drum type electrophotographic photosensitive member (referred to as photosensitive drum" hereinafter) 1 as an image bearing body. Around the photosensitive drum 1, there are disposed a charging roller 2, a developing apparatus 3, a transfer roller 4 and a cleaning blade 5, and an exposing apparatus 6 is disposed between the charging roller 2 and the developing apparatus 3. Further, a fixing apparatus is disposed at a downstream side of a transfer nip between the photosensitive drum 1 and the transfer roller 4 in a transfer material conveying direction.

The photosensitive drum 1 is for example an organic photosensitive member having negative charging polarity and is constituted by coating a photosensitive layer (not shown) on an aluminium drum substrate (not shown) and is rotated at a predetermined peripheral speed in a direction shown by the arrow (clockwise direction). During the rotation, the drum is negatively charged uniformly with predetermined potential.

The charging roller 2 as charging means is rotatingly contacted with the surface of the photosensitive drum 1 and serves to negatively charge the photosensitive drum 1 with the predetermined potential by charging bias applied to a charging bias power source (not shown).

The developing apparatus 3 is a contact one-component developing apparatus for effecting development with nonmagnetic toner T as one-component developer and includes a developing roller 9 as developer carrying body) opposed to the photosensitive drum 1 at an opening portion of a developing container 8 and is rotatable in a direction shown by the arrow (counterclockwise direction), a rotatable elastic roller 10 urged against the developing roller 9, a regulating blade 11 having elasticity and abutting against the developing roller 9, and an agitating member 12 for agitating the toner T in the developing container 8. The regulating blade 11 abuts against the developing roller 9 at a downstream side of the abut portion between the developing roller 9 and the elastic roller 10 in a rotational direction of the developing roller 9.

The toner T agitated by the agitating member 12 is supplied to a surface of the developing roller 9 by the rotating elastic roller 10 urged against the developing roller 9. The toner T supplied to the surface of the developing roller 9 is carried by the rotation of the developing roller 9 and is subjected to charging by friction in the abut portion between the regulating blade 11 and the developing roller 9 and is formed as a thin toner on the surface of the developing roller 9. The toner in the thin layer is carried by the rotation of the developing roller 9 and is adhered to the electrostatic latent image formed on the photosensitive drum 1 in the abut portion (developing portion) between the photosensitive drum 1 and the developing roller, thereby visualizing the latent image as a toner image. Incidentally, the toner on the developing roller 9, which did not contribute to the developing is scraped off by the elastic roller 10.

The transfer roller 4 as transferring means is urged against the surface of the photosensitive drum 1 with predetermined pressure to define a transfer nip therebetween and serves to transfer the toner image formed on the surface of the photosensitive drum 1 onto a transfer material P in the transfer nip between the photosensitive drum 1 and the transfer roller 4, by the transfer bias applied from the transfer bias power source (not shown).

The cleaning blade 5 serves to remove residual toner remaining on the surface of the photosensitive drum 1 after the transferring.

The exposing apparatus 6 includes a laser driver, a laser diode and a polygon mirror 14. In the exposing apparatus, a laser beam modulated in correspondence to a time-lapse electrical digital image signal of image information inputted to the laser driver is outputted from the laser diode, and, by scanning the laser beam by the polygon mirror rotating at a high speed and by effecting image exposure L on the surface of the photosensitive drum 1 through an optical lens system 15, an electrostatic latent image corresponding to the image information is formed.

The fixing apparatus 7 includes a fixing roller 7*a* and a pressing roller 7*b*. In the fixing apparatus, while the transfer material P is being pinched and conveyed in a fixing nip between the fixing roller 7*a* and the pressing roller 7*b*, the toner image transferred to the surface of the transfer material P is thermally fixed onto the transfer material by heat and pressure.

Next, an image forming operation of the image forming apparatus will be explained.

During the image formation, the photosensitive drum 1 is rotated by driving means (not shown) at the predetermined peripheral speed in the direction shown by the arrow and is uniformly charged by the charging roller 2. The image exposure L is given to the charged surface of the photosensitive drum 1 by the exposing apparatus 6, thereby forming the electrostatic latent image corresponding to the inputted image information.

By applying developing bias having the same polarity as a charging polarity (negative polarity) of the photosensitive drum 1 to the developing roller 9 of the developing apparatus 3, in the developing portion, the toner T charged with the same polarity as the charging polarity (negative polarity) of the photosensitive drum 1 is adhered to the electrostatic latent image formed on the photosensitive drum 1, thereby visualizing the latent image as the toner image. When the toner image on the photosensitive drum 1 reaches the transfer nip between the photosensitive drum 1 and the transfer roller 4, in synchronism with this, the transfer material P, such as paper supplied by a pick-up roller 16, is conveyed to the transfer nip through a registration roller pair (not shown).

By applying transfer bias having polarity (positive polarity) opposite to the polarity of the toner to the transfer roller 4, the toner image on the photosensitive drum 1 is transferred onto the transfer material P conveyed to the transfer nip. The transfer material P to which the toner image was transferred is conveyed to the fixing apparatus 7, where the transfer material P is heated and pressurized in the fixing nip between the fixing roller 7*a* and the pressing roller 7*b* to thermally fix the toner image to the transfer material. Thereafter, the transfer material is discharged onto a sheet discharge tray 17. In this way, a series of image forming operations are finished.

On the other hand, after the toner image transferring, residual toner remaining on the surface of the photosensitive drum 1 is removed by the cleaning blade 5 and is collected into a waste toner container 13.

Incidentally, in the image forming apparatus having the above-mentioned conventional nonmagnetic one-component contact type developing apparatus, as the number of imaged copies is increased, deterioration of the toner is prompted and the toner particles charged with polarity opposite to the normal polarity are increased. The toner charged with opposite polarity is shifted to a nonimaged portion on the photosensitive drum 1 (this phenomenon is referred to as "reversal fog"). Although such reversal fog is hard to be transferred to the transfer material P and does almost not affect an influence upon the image, it increases toner consumption greatly. Consequently, the number of image formable sheets corresponding to a toner filling amount replenished in the developing container 8 is reduced, with the result that a service life of the developing apparatus cannot be extended.

Further, in the development of the conventional developing apparatus 3 of nonmagnetic one-component contact developing type, as shown in FIG. 11, so long as the charging amount of toner is in a proper range ($|35|$ to $|80|$ $\mu$C/g), control can be effected in such a manner that a height of a line image becomes equal to a height of a solid image, and the line image can be controlled to required minimum toner height. Incidentally, in FIG. 11, the ordinate indicates a toner height ratio of line image/solid image, and the abscissa indicates the toner charging amount on the developing roller 9.

As the reason why the toner height of the line image becomes great, it is considered that, if the developing is permitted in an area (where the developing roller 9 is separated from the photosensitive drum 1) downstream of the abut portion (developing portion) between the developing roller 9 and the photosensitive drum 1, the toner on the developing roller 9 is swept together to increase the toner height of the line image. Further, if the toner charging amount on the developing roller 9 is increased, the toner holding force of the developing roller 9 due to a mirror symmetry force is increased, thereby preventing "sweeping-together". Thus, sharp lines and/or dots without scattering can be reproduced.

However, if the toner charging amount on the developing roller 9 is decreased due to the deterioration of toner caused by the increase in the number of imaged copies, the toner height of the line image is increased, with the result that not only the toner consumption is increased but also reduction of image quality such as line scattering or dot squeezing occurs.

In consideration of this, recently, in place of the above-mentioned nomnagnetic one-component contact developing system, for the purpose of obtaining stability of the toner charging amount and reduction in reversal fog, there has been proposed a developing system in which toner is electrically charged by using a toner charging roller as developer charging member.

A developing apparatus using the toner charging roller is shown in FIG. 12. Incidentally, elements having the same functions as those in the developing apparatus of the above-mentioned image forming apparatus are designated by the same reference characters and a duplicated explanation thereof will be omitted.

The illustrated developing apparatus 3 includes a rotatable toner charging roller 20 urged against the developing roller 9. The toner charging roller 20 is disposed at an upstream side of the regulating blade 11 in the rotational direction of the developing roller 9. The other arrangements are the same as those in the above-mentioned developing apparatus 3.

In the developing operation of this developing apparatus 3, the toner T agitated by the agitating member 12 is supplied to the surface of the developing roller 9 by the rotating elastic roller 10 urged against the developing roller 9. The toner supplied to the surface of the developing roller 9 to which the developing bias was applied is carried by the rotation of the developing roller 9 and is charged by friction in the abut portion between the regulating blade 11 and the developing roller 9 and is formed as a thin toner layer on the developing roller 9. Further, by electrical charging due to discharging of the toner charging roller 20 to which the charging bias was applied, charges are given to the toner on the developing roller 9. The toner formed as the thin layer and charged is carried by the rotation of the developing roller 9 and is adhered to the electrostatic latent image formed on the photosensitive drum 1 in the abut portion (developing portion) between the photosensitive drum 1 and the developing roller, thereby visualizing the latent image. Thereafter, the residual toner remaining on the developing roller 9, which was not developed in the abut portion between the photosensitive drum 1 and the developing roller 9 is removed by the elastic roller 10 and is returned to the developing container 8.

In this way, when the toner charging roller 20 is used, the reversal fog can be reduced and stable toner charging amount can be obtained.

However, in the developing apparatus 3 having the above-mentioned toner charging roller 20, as the number of imaged copies is increased, the toner charging roller 20 is contaminated by toner (particularly, toner having opposite polarity) to cause poor charging, thereby reducing the charge applying ability of the toner charging roller 20. Thus, the toner charging amount on the developing roller 9 is decreased and the reversal fog is increased.

SUMMARY OF THE INVENTION

An object of the present invention is to provide a developing apparatus which can obtain a stable toner charging amount even if a developer charging member is contaminated by toner and reduce reversal fog to reduce toner consumption.

DESCRIPTION OF THE PREFERRED EMBODIMENTS

<First Embodiment>

Figure 1:
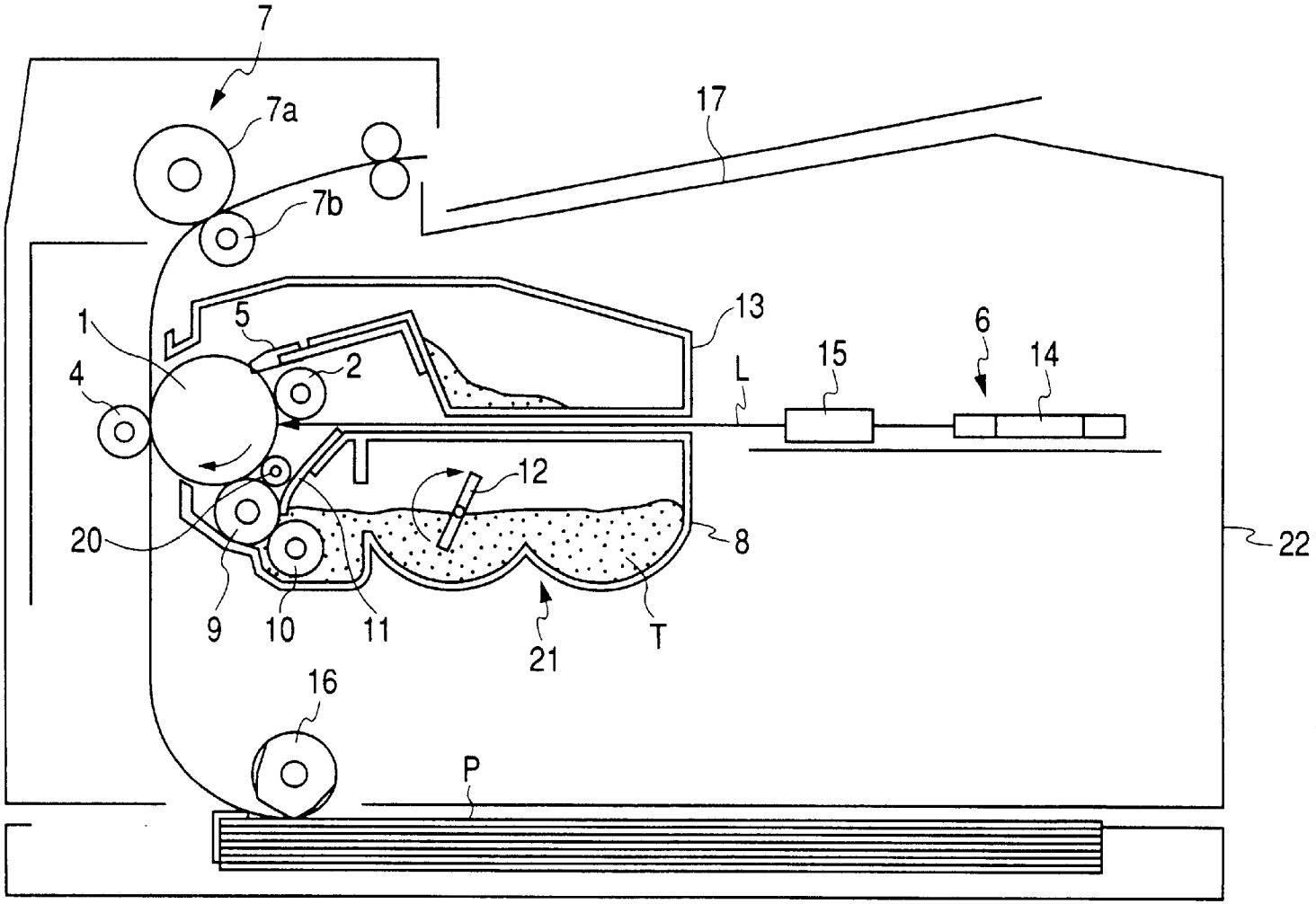
FIG. 1 is a schematic constructural view showing an image forming apparatus having a developing apparatus according to a first embodiment of the present invention.
Figure 10:
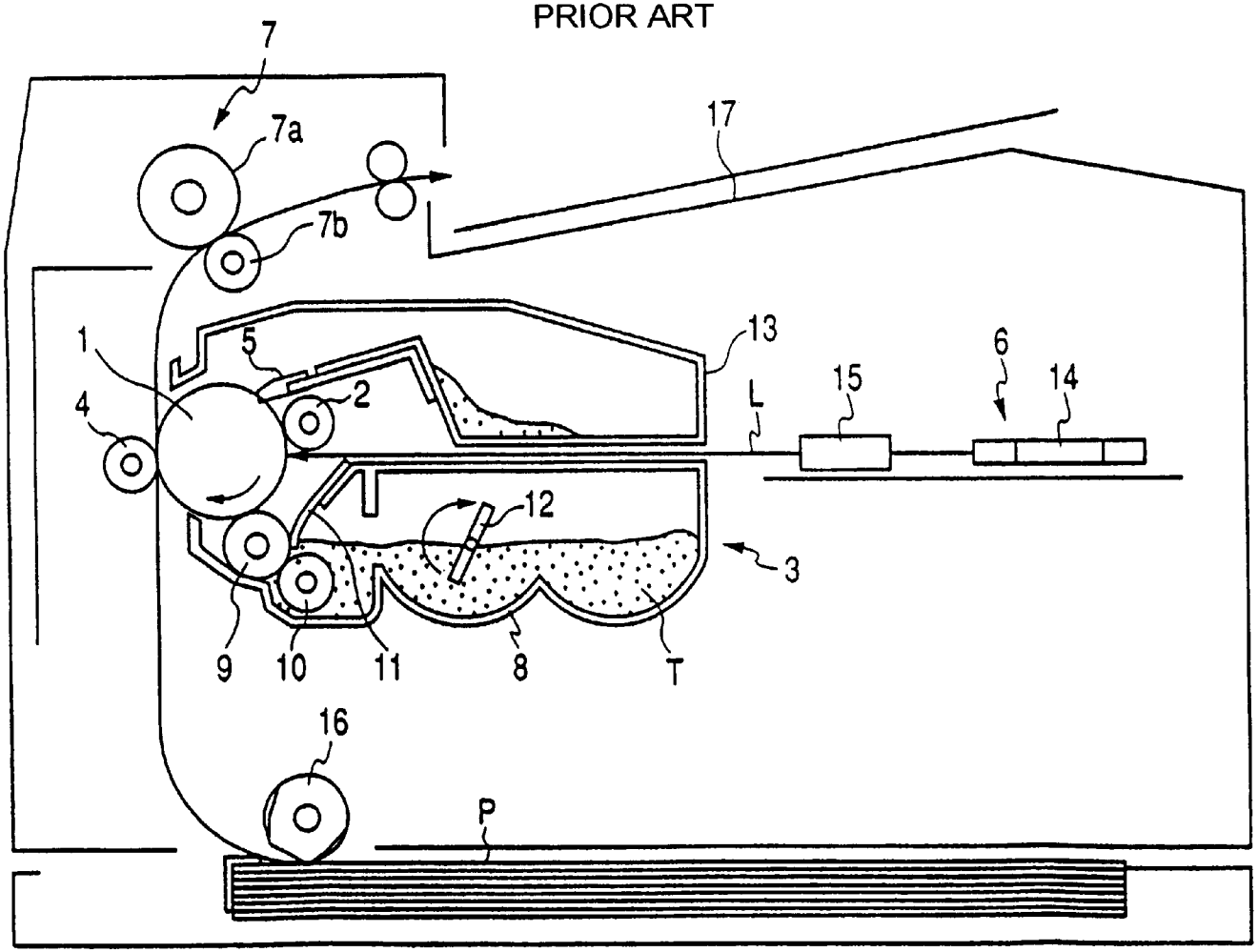
FIG. 10 PRIOR ART
FIG. 10 is a schematic constructural view showing an image forming apparatus having a conventional developing apparatus.
Figure 12:
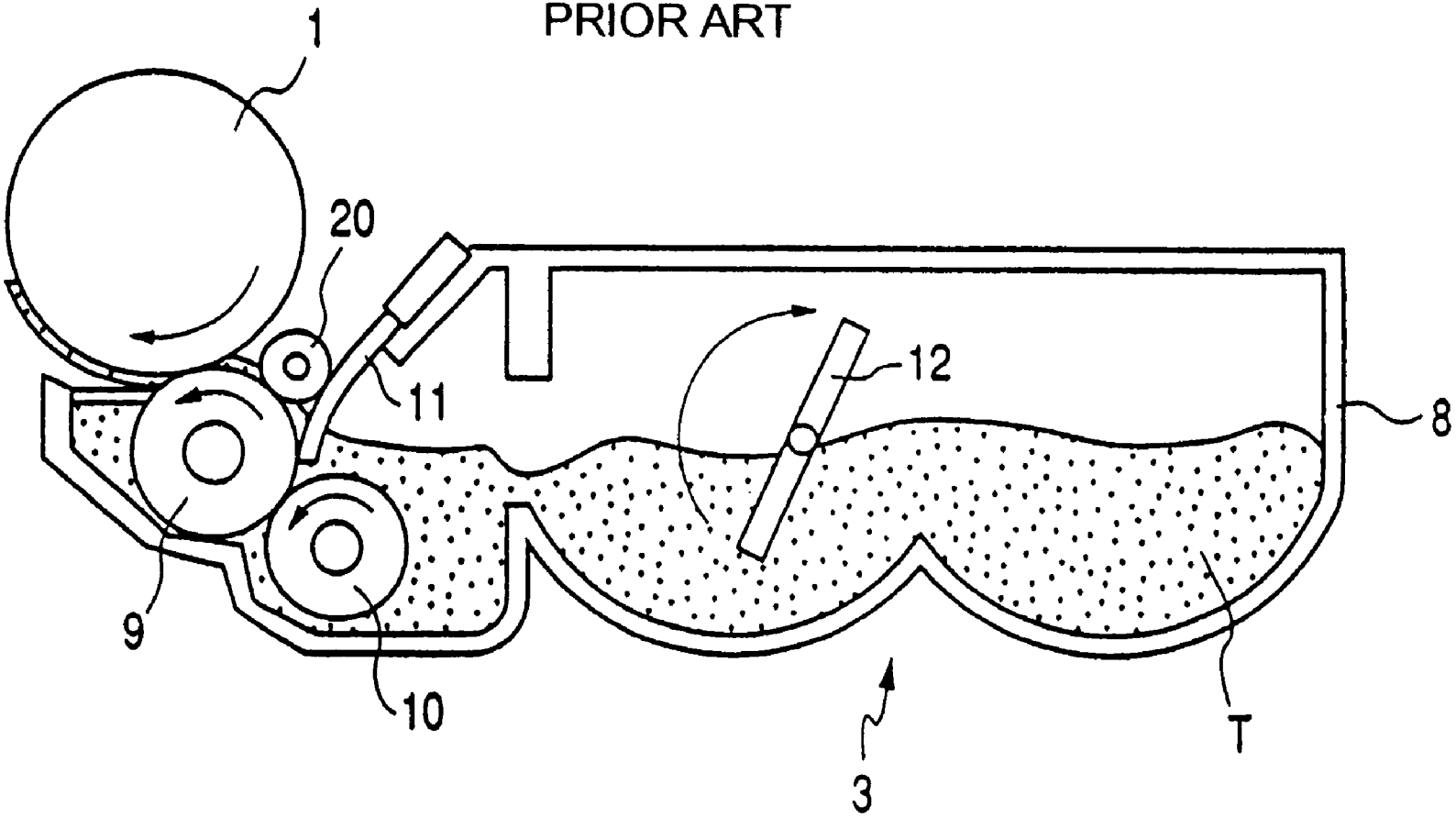
FIG. 12 PRIOR ART
FIG. 12 is a schematic constructural view showing the conventional developing apparatus.

FIG. 1 is a schematic constructural view showing an image forming apparatus having a developing apparatus according to a first embodiment of the present invention. The developing apparatus of the image forming apparatus according to the first embodiment includes a toner charging roller as a developer charging member urged against a developing roller as a developer carrying body and adapted to charge toner on the developing roller. Incidentally, members or parts having the same functions as those in the conventional image forming apparatus shown in FIG. 10 and those in the conventional developing apparatus shown in FIG. 12 are designated by the same reference characters and a duplicated explanation thereof will be omitted.

Similar to the above-mentioned conventional case, also in the image forming apparatus according to the first embodiment, an image exposure L is given, by an exposing apparatus 6, to a photosensitive drum 1 charged by a charging roller 2 to which charging bias (for example, DC voltage of −1300 V) was applied and rotated at a speed of 1 rps in a direction shown by the arrow (clockwise direction), thereby forming an electrostatic latent image corresponding to inputted image information. In this case, a laser power of the exposing apparatus 6 is adjusted so that potential of a dark portion (subjected to the image exposure L) becomes −150 V. By using a developing roller 9 of the developing apparatus 21 to which developing bias having the same polarity as charging polarity (negative polarity) of the photosensitive drum 1, in a developing portion, non-magnetic toner T as one-component developer charged with the same polarity as charging polarity (negative polarity) of the photosensitive drum 1 is adhered to the electrostatic latent image to effect reversal developing, thereby visualizing the latent image as a toner image (detailed explanation of the developing apparatus 21 and developer (toner T) will be fully described later).

When the toner image on the photosensitive drum 1 reaches a transfer nip between the photosensitive drum 1 and a transfer roller 4, in synchronism with this, a transfer material P, such as paper, supplied by a pick-up roller 16 is conveyed to the transfer nip through a registration roller pair (not shown). By applying transfer bias having polarity (positive polarity) opposite to the polarity of the toner to the transfer roller 4, the toner image on the photosensitive drum 1 is transferred onto the transfer material. The transfer material P to which the toner image was transferred is conveyed to a fixing apparatus 7, where the transfer material P is heated and pressurized in a fixing nip between a fixing roller 7*a* and a pressing roller 7*b* to thermally fix the toner image to the transfer material. Thereafter, the transfer material is discharged onto a sheet discharge tray 17. On the other hand, after the toner image transferring, residual toner remaining on the surface of the photosensitive drum 1 is removed by a cleaning blade 5 and is collected into a waste toner container 13.

Further, in the illustrated embodiment, the photosensitive drum 1 and the developing apparatus 21 are integrally formed as a process cartridge which can detachably be mounted to a main body 22 of the image forming apparatus.

Next, the developing apparatus 21 according to the illustrated embodiment will be described.

Figure 2:
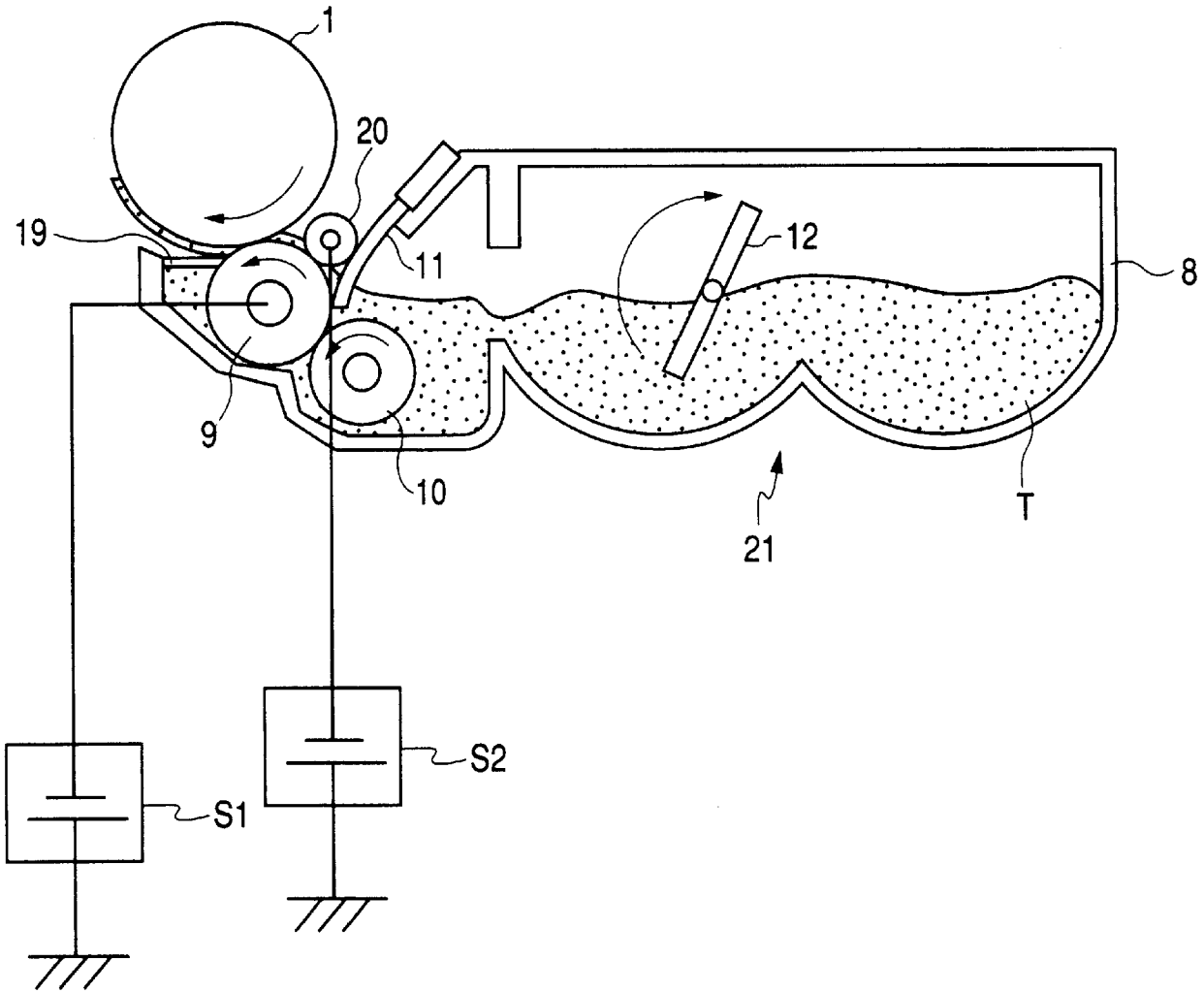
FIG. 2 is a schematic constructural view of the developing apparatus according to the first embodiment.

As shown in FIGS. 1 and 2, the developing apparatus 21 includes a developing roller 9 opposed to the photosensitive drum 1 at an opening portion extending in a longitudinal direction of a developing container 8 containing the toner T and rotatable in a direction shown by the arrow (counterclockwise direction) and having a diameter of 16 mm, a rotatable elastic roller 10 urged against the developing roller 9, a regulating blade 11 as developer regulating member having elasticity and abutting against the developing roller 9, an agitating member 12 for agitating the toner T, and the rotatable toner charging roller 20 urged against the developing roller 9.

The developing roller 9 is contacted with the photosensitive drum 1 with an abut portion width and is rotated in a peripheral speed (for example, 170 mm/sec) greater than the peripheral speed (for example, 94.2 mni/sec) of the photosensitive drum 1. A surface of the developing roller 9 has proper unevenness for increasing the sliding contact ratio with the toner T and effecting good conveyance of the toner T, and, in the illustrated embodiment, the developing roller is constituted by coating a thin layer of acryl-urethane group on a silicone rubber layer having a diameter of 16 mm, a length of 240 mm and a thickness of 4 mm. The developing roller 9 is connected to a developing bias power supply S1 so that developing bias having predetermined potential with negative polarity is applied to the developing roller 9 from the developing bias power supply S1.

Further, the developing roller 9 has resistance of $10^4$ to $10^6\Omega$. surface roughness of 0.5 to 0.9 $\mu$m and Asker C hardness of 45° (load of 1 Kg). The measurement of the resistance value of the developing roller 9 was effected by abutting an aluminium roller (not shown) having a diameter of 30 mm against the developing roller 9 along an entire longitudinal area with abutting load of 500 gF (4.9 N) and by rotating the aluminium roller at a speed of 0.5 rps. DC voltage of −400 V was applied to the developing roller 9, and resistance of 10 kΩ was provided as ground resistance. Voltages at both ends of the resistance were measured, and electrical current values were calculated on the basis of the measured voltage values thereby to calculate the resistance of the developing roller 9.

Further, a flexible seal member 19 is provided at a downstream side of the abut portion (developing portion) between the developing roller 9 and the surface of the photosensitive drum 1 in the rotational direction of the developing roller 9. The seal member 19 permits passage of nondeveloped toner into the developing container 8 and prevents the toner T in the developing container 8 from leaking from the downstream side of the rotational direction of the developing roller 9 with respect to the abut portion between the developing roller 9 and the surface of the photosensitive drum 1.

The elastic roller 10 is urged against the developing roller 9 at an upstream side of the abut portion between the regulating blade 11 and the developing roller 9 in the rotational direction of the developing roller 9 and is rotatingly driven in a direction shown by the arrow (counterclockwise direction). Further, it is preferable that the elastic roller 10 has a foam skeleton sponge structure or a fur brush structure in which fibers made of rayon on nylon are mounted on a metal core, in the viewpoint of the supplying of the toner T to the developing roller 9 and the stripping of the nondeveloped toner. In the illustrated embodiment, an elastic roller 10 having a diameter of 16 mm in which polyurethane foam is coated on a metal core is used. An abut width of the elastic roller 10 against the developing roller 9 is effective when such a width is selected to 1 to 6 mm. Further, it is preferable that a relative speed is creased between the elastic roller and the developing roller 9 in the abut portion thereof. In the illustrated embodiment, the abut width against the developing roller 9 is set to 3 mm, and the elastic roller 10 is rotated by driving means (not shown) at a predetermined timing so that the peripheral speed of the elastic roller becomes 80 mm/sec during the developing operation.

A distal end portion of the regulating blade 11 elastically abuts against the outer peripheral surface of the developing roller 9 with surface contact at an upstream side of the abut portion between the developing roller 9 and the surface of the elastic roller 10 in the rotational direction of the developing roller 9. The regulating blade 11 is constituted by adhering rubber material (at a side toward the developing roller 9) onto a substrate formed from rubber material such as silicone or urethane or a metal thin plate having spring elasticity and made of SUS or bronze phosphate. In the illustrated embodiment, a regulating blade 11 having a thickness of 1.0 mm and formed from plate-shaped urethane rubber is used. Further, the abut pressure of the regulating blade 11 against the developing roller 9 is set to 25 to 35 gf/cm (measurement of line pressure is calculated from a value obtained by pulling off, by means of a spring balancer, a central plate among three metal thin plates having known coefficient of friction and interposed in the abut portion). The abut direction of the regulating blade 11 against the developing roller 9 is a so-called counter direction in which the distal end of the regulating blade directs toward the upstream side of the rotational direction of the developing roller 9 in the abut portion.

The toner charging roller 20 is constituted by a rubber roller and is urged against the developing roller 9 at a downstream side of the abut portion between the regulating blade 11 and the developing roller 9 in the rotational direction of the developing roller 9 and is rotatingly driven by the rotation of the developing roller 9. The toner charging roller 20 is connected to a toner charging bias power source S2, so that toner charging bias having predetermined potential and negative polarity (polarity of toner normally charged) is applied from the toner charging bias power source S2 to the toner charging roller 20, thereby charging the toner T adhered to the surface of the developing roller 9 by discharging.

The toner T loaded in the developing container 8 is nonmagnetic one-component developer. Toner (comprised of spherical toner particles having smooth surfaces) having good transferring ability and high lubricating ability so that, when residual toner remaining on the photosensitive drum 1 which was not transferred is cleaned by the cleaning blade 5, the photosensitive drum 1 is less worn, may be used.

As shape coefficient of the toner T, SF-1 is selected to 100 to 180 and SF-2 is selected to 100 to 140. SF-1, SF-2 are defined as values obtained by sampling 100 images at random by using FE-SEM (S-800) manufactured by Hitachi Ltd. and by analyzing image information introduced into an image analyzing device (LUZEX 3) manufactured by Nicolet Japan Corporation through an interface and by calculating the analyzed results on the basis of the following equations:

$$SF\text{-}1=\{(MXLNG)^2/\mathrm{AREA}\}\times(100\pi/4) \quad (1)$$

$$SF\text{-}2=\{(PERI)^2/\mathrm{AREA}\}\times(100/4\pi) \quad (2)$$

Where, AREA is toner projecting area, MXLNG is absolute maximum length and PERI is peripheral length.

The shape coefficient SF-1 of the toner T represents a spherical degree, and, as the value is increased from 100, the shape gradually becomes unfixed form. On the other hand, SF-2 represents unevenness degree, and, as the value is increased from 100, unevenness of the toner surface becomes more noticeable.

So long as the toner is in the above-mentioned shape coefficient (SF-1, SF-2) range, as methods for manufacturing the toner T, as well as a manufacturing method using a grinding technique, a method for directly producing toner by using a suspension polymerizing methods disclosed in Japanese Patent Application Laid-Open Nos. 36-10231 and 59-53856, or a dispersion polymerizing method for directly producing toner by using aqueous organic solvent which is soluble in monomer and in which obtained polymer is not soluble, or a method for manufacturing toner by using an emulsification polymerizing method such as a soap free polymerizing methods for producing the toner by directly effecting polymerization under the presence of water soluble polarity polymerization starting agent may be used.

Figure 11:
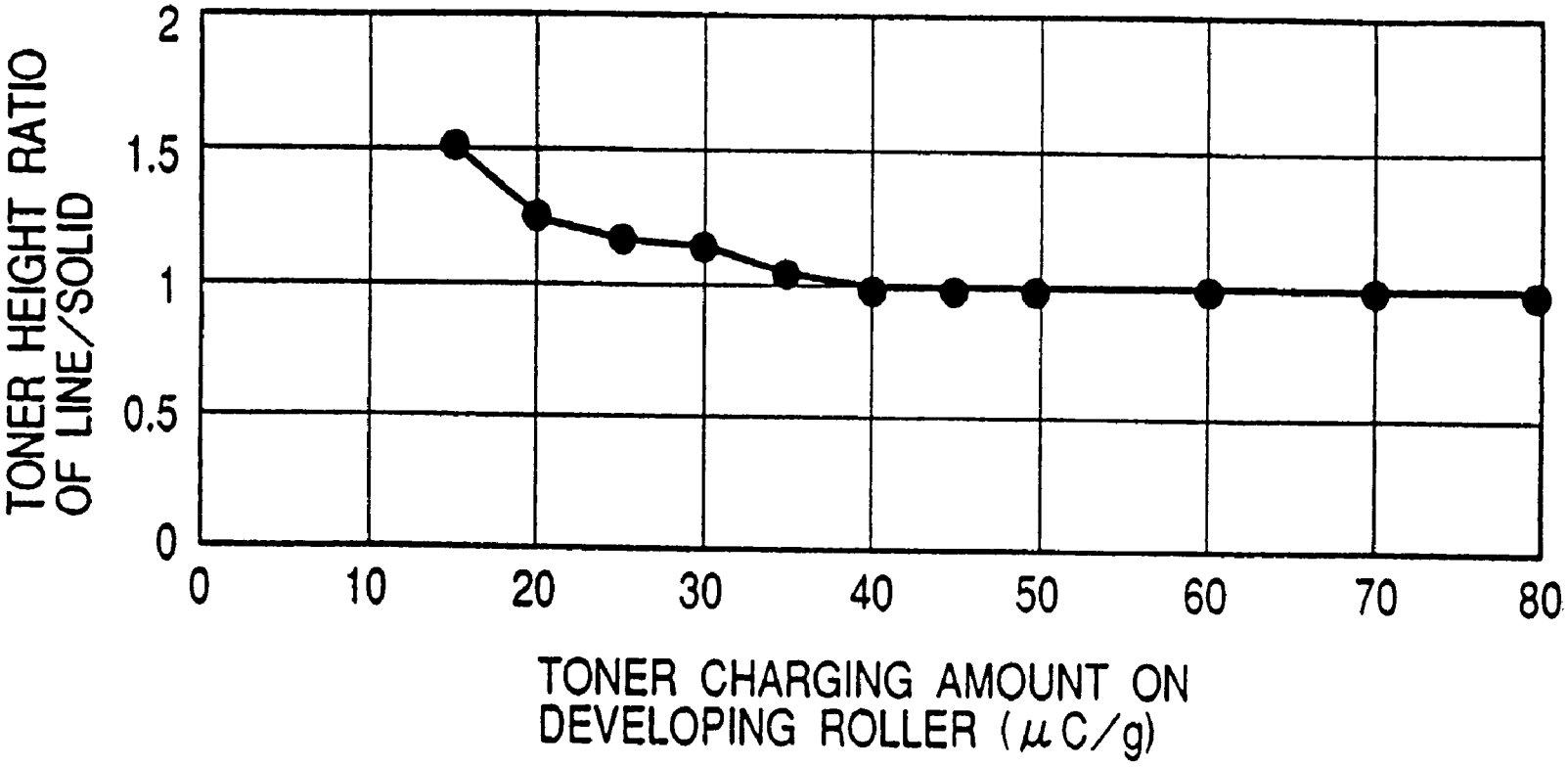
FIG. 11 PRIOR ART
FIG. 11 is a view showing a relationship between a toner charging amount on a developing roller and a toner height ratio of line image/solid image in the conventional developing apparatus.

As explained in connection with FIG. 11, the toner charging amount is preferably |35| to |80| $\mu$C/g.

In the illustrated embodiment, the suspension polymerizing method in which the shape coefficient SF-1 and SF-2 of the toner T can easily be controlled to 100 to 180 and 100 to 140, respectively and fine toner particles having sharp particle size distribution and particle diameter of 4 to 8 $\mu$m can easily be obtained was used under normal pressure or increased pressure, and, styrene and n-butyl acrylate were added as a monomer and metal compound salicylate was added as charging controlling agent and saturated polyester was added as polarity range and coloring agent was further added, thereby manufacturing colored suspended particles having weight average particle diameter of 7 $\mu$m.

By externally adding to this hydrophobic silica of 1.5 parts by weight, the above-mentioned toner T having good transferring ability and negative polarity was manufactured. A toner volume resistance value of the toner T is $10^{14}$ Ω·cm or more. Further, in this example, DHT-4A (manufactured by Kyowa Chemical Industry Co., Ltd.) of 0.5 part by weight as conductive particles is externally added to the toner T. The conductive particles exist on the surface of the toner T.

The measurement of the volume resistance value of the toner T is effected by using a weight having a diameter of 6 mm (ϕ6 mm), measurement electrode plate area of 0.283 $cm^2$ and pressure of 1500 g and by setting pressure to 96.1 kPa and powder layer thickness (in measurement) to 0.5 to 1.0 mm and by measuring an electrical current value regarding DC voltage of 400 V by means of a minute ammeter (YHP 4140 pA METER/DC VOLTAGE SOURCE) and by calculating the volume resistance value (specific resistance) on the basis of the measured electrical current value.

Next, the developing operation of the developing apparatus 21 according to the illustrated embodiment will be explained.

In the developing operation, the toner T in the developing container 8 is sent toward the elastic roller 10 by the rotation (clockwise rotation) of the agitating member 12. Then, the toner T is conveyed to the vicinity of the developing roller 9 by the rotating (counterclockwise rotation) of the elastic roller 10. In the abut portion between the developing roller 9 and the elastic roller 10, the toner T borne on the elastic roller 10 is subjected to triboelectricity by the sliding contact with the developing roller 9 and is adhered onto the developing roller 9.

As the developing roller 9 is rotated in the direction shown by the arrow (counterclockwise direction), the toner T is sent below the elastic blade 11, thereby forming the thin layer on the developing roller 9. In the illustrated embodiment, the good charging amount of the toner T is set to −60 to −20 $\mu$C/g and the good toner coating amount is set to 0.4 to 1.0 mg/$cm^2$ to obtain the toner layer thickness of 10 to 20 $\mu$m.

In order to maintain high charging amount of the toner T adhered to the developing roller 9, the toner T is charged by the discharging caused by the toner charging roller 20 urged against the entire image forming area formed on the developing roller 9. The toner charging roller 20 is urged against the developing roller 9 with abut load of 100 to 200 gF (0.98 to 1.96 N) by means of an urging member (not shown). Due to the abutment of the toner charging roller 20, the toner T is minutely loaded on the developing roller 9 and is uniformly coated thereon. Incidentally, a positional relationship between the regulating blade 11 and the toner charging roller 20 in a longitudinal direction is preferably selected to positively cover the entire abut area of the regulating blade 11 on the developing roller 9.

The measurement of the charging amount of the toner on the developing roller is effected as follows.

The one-component developer borne on the developer carrying body is collected by a collector. A membrane filter is mounted to the collector, and the one-component developer borne on the developer carrying body is sucked by a suction force of 200 mm $H_2O$. An electrometer (Model 617 type manufactured by KEITHKEY Co.) is connected to the collector to measure the charging amount of the one-component developer collected by the collector.

Now, a method for applying charges to the toner T on the developing roller 9 by means of the toner charging roller 20 will be described.

Figure 3:
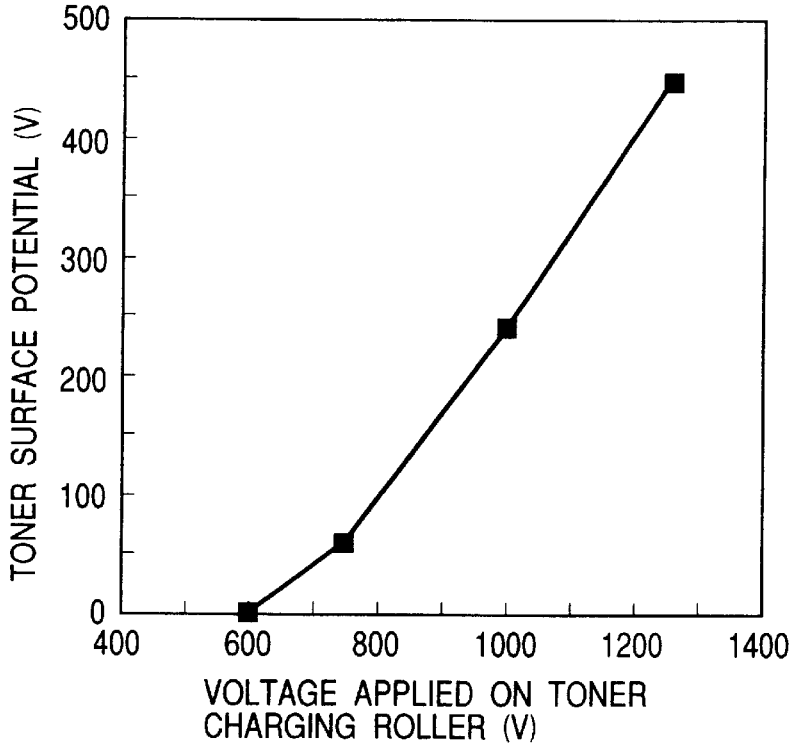
FIG. 3 is a view showing a relationship between voltage applied to a toner charging roller and toner surface potential, when surface potential due to frictional charging is removed.

In case where the resistance of the toner charging roller 20 is $10^8$ Ω, when a relationship between voltage applied to the toner charging roller 20 and surface potential of toner T on the developing roller was examined, it was found that the surface potential of the toner (toner surface potential) is maintained to about −20 V even when the voltage applied from the toner charging bias power source S2 is 0 V. The reason is that it is subjected to friction charging from the elastic roller 10 and the regulating blade 11. If the surface potential due to the friction charging is removed or omitted, as shown in FIG. 3, the charging of the toner T on the developing roller rises up from the discharging start voltage of about −600 V and effects the same performance of the DC discharge charging of the charging roller 2 against the photosensitive drum 1.

The discharging start voltage of toner T on the developing roller and the toner charging roller 20 is determined by a cross point between the following equations (3) and (4). That is to say, $$Vb=312+6.2\ g \tag{3}$$

$$Vg=g(Va-Vc)/(Lt/Kt)+g) \tag{4}$$

Incidentally, in the above equations (3) and (4), g: spacial distance between toner charging roller 20 and surface of toner layer;

Vb: approximation formula of Paschen Law when g>8 $\mu$m;

Vg: space voltage between toner charging roller 20 and surface of toner layer;

Va: voltage applied to toner charging roller 20;

Vc: surface potential of toner layer;

Lt: thickness of toner layer; and

Kt: specific dielectric constant of toner layer.

Accordingly, the voltage applied to the toner charging roller may be not smaller than the discharging start voltage for the toner on the developing roller.

Figure 4:
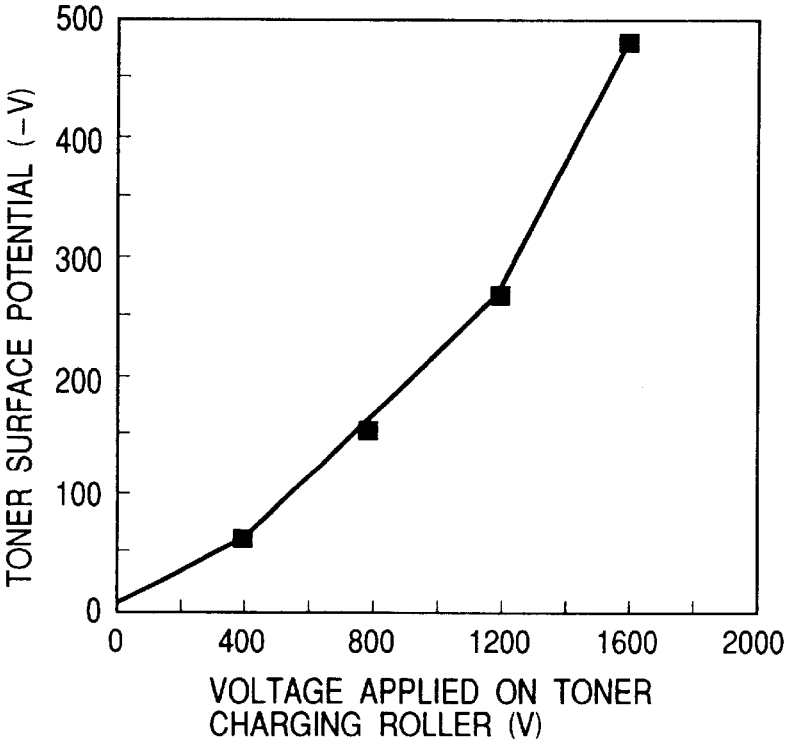
FIG. 4 is a view showing a relationship between voltage applied to a toner charging roller and toner surface potential, when injection charging is effected.

Since the toner T used in the illustrated embodiment has excellent particle size distribution and includes spherical particles, a ratio between the toner and air in the toner layer becomes constant, with the result that "Kt" in the above equation (4) is stabilized, thereby permitting application of charges due to stable discharging. Another method for applying the charges to the toner T is injection charging. In this case, the voltage applied to the toner charging roller 20 and the surface potential of the toner T becomes as shown in FIG. 4. From the above results, it is considered that the charge applying method according to the illustrated embodiment shown in FIG. 3 utilizes the discharging.

The tests shown in FIGS. 3 and 4 relate to a case where the entire longitudinal area of the toner charging roller 20 abuts against a coat portion of the toner T. If the toner dischargeable resistance range of the toner charging roller 20 is equal to or smaller than $10^7$ Ω, the voltage capable of effecting the discharging cannot be obtained between the toner charging roller 20 and the coat portion of the toner T. On the other hand, such resistance range is equal to or greater than $10^{12}$ Ω, with the arrangement according to the illustrated embodiment, since the discharging start voltage becomes too great, such arrangement is not desirable.

Accordingly, the proper range of the resistance of the toner charging roller 20 is $10^8$ to $10^{11}$ Ω, and, in the illustrated embodiment, when the developing roller having resistance of $10^4$ to $10^6$ Ω is used, the resistance of the toner charging roller 20 will be included within the above proper range.

The measurement of the resistance value of the toner charging roller 20 is effected by abutting an aluminium roller (not shown) having a diameter of 30 mm and a length of 220 mm against the toner charging roller 20 with abut load of 170 gF (1.67 N) along the entire longitudinal area and by rotating the aluminium roller at a speed of 0.5 rps. DC voltage of −400 V is applied to the toner charging roller 20, and resistance of 100 kΩ is provided as ground resistance. Voltage at both ends of the resistance are measured, and electrical current values are calculated on the basis of the measured voltage values thereby to calculate the resistance of the toner charging roller 20.

Figure 5:
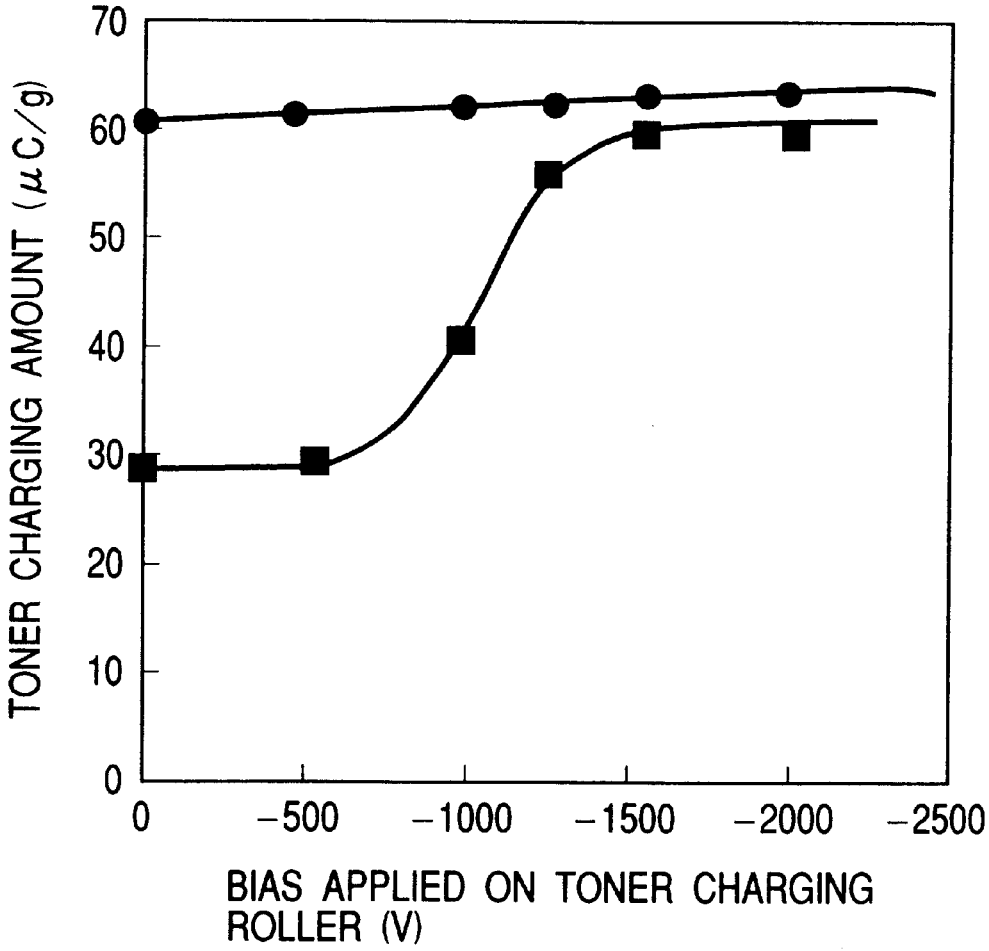
FIG. 5 is a view showing a relationship between voltage applied to a toner charging roller and a toner charging amount.

Further, according to tests conducted by the Inventors, as a result of examination of a relationship between voltage the toner charging roller 20 and the developing roller 9 (bias applied to the toner charging roller 20) and the charging amount of toner T on the developing roller 9, a result as shown in FIG. 5 was obtained. As shown in FIG. 5, in a case where the charging amount of the toner T passed through the regulating blade 11 is −30 μC/g, when the bias applied to the toner charging roller 20 is greater than about −1200 V, it is saturated to about −60 μC/g. On the other hand, in a case where the charging amount of the toner T passed through the regulating blade 11 is −60 μC/g, regardless of the bias applied to the toner charging roller 20, the charging amount of the toner T is constant (about −60 μC/g). Accordingly, even if the charging amount of the toner T is varied with the usage condition of the toner charging roller 20 (high temperature/high humidity condition, low temperature/low humidity condition or the like), high charging amount can be maintained.

Figure 6:
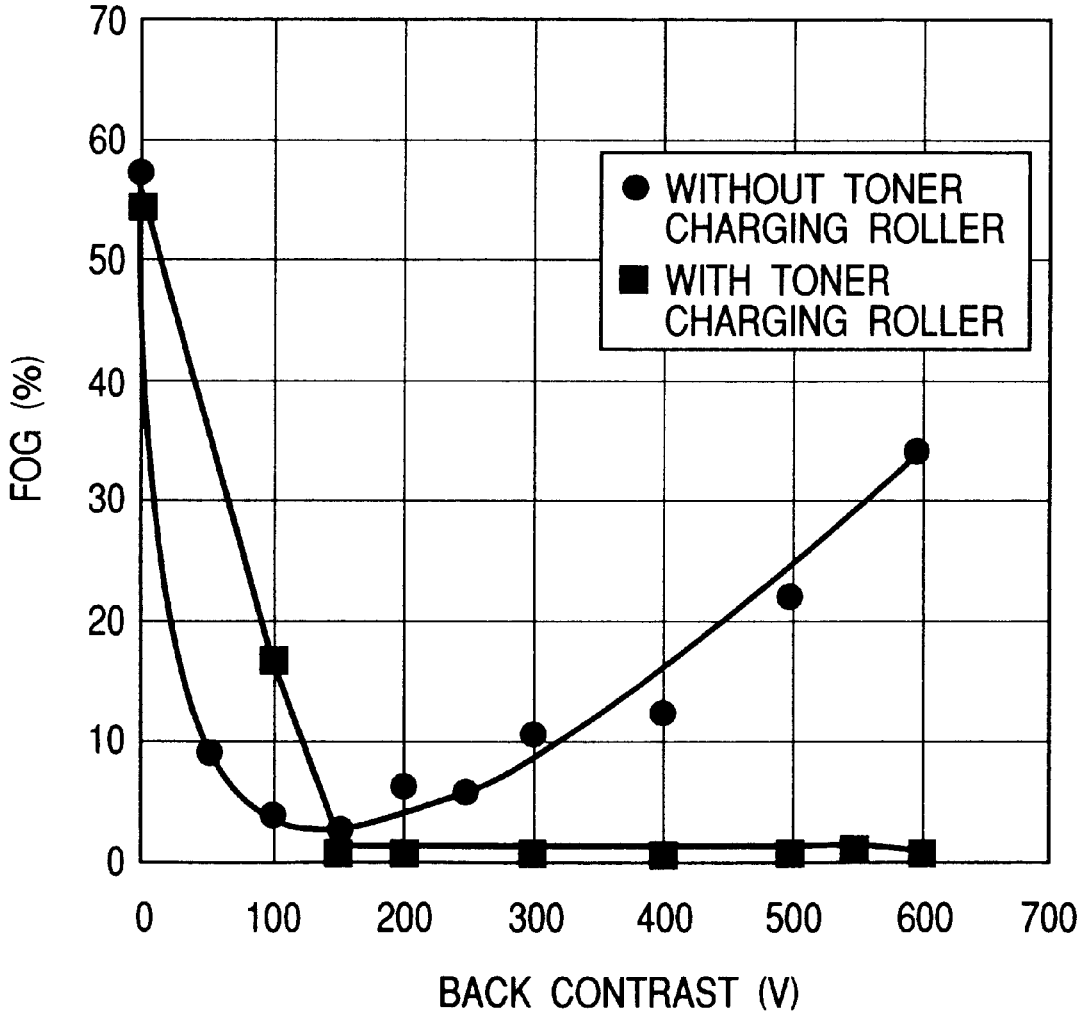
FIG. 6 is a view showing a relationship between back contrast and fog.

Further, in the illustrated embodiment, as a result of examination of a relationship between back contrast potential (potential difference between potential of dark portion on the photosensitive drum 1 and the developing bias potential) and the above-mentioned fog (reversal fog), a result as shown in FIG. 6 was obtained. As shown in FIG. 6, if there is no toner charging roller 20 (black circles in FIG. 6), as the back contrast potential is increased, the reversal fog on the photosensitive drum 1 is also increased; whereas, if there is the toner charging roller 20 (black squares in FIG. 6), even when the back contrast potential is increased, the reversal fog on the photosensitive drum 1 is substantially suppressed.

In the measurement of the reversal fog, fog toner transferred onto the photosensitive drum 1 was collected by a transparent adhesive tape, and this sample tape and an unused adhesive tape (to which no substance is adhered) (reference tape) were adhered onto a white paper, and respective reflectance factors were measured, and fog density was determined by subtracting the reflectance factor of the sample tape from the reflectance factor of the reference tape. The reflectance factors were measured by TC-6DS manufactured by Tokyo Denshoku Co., Ltd.

Further, in the illustrated embodiment, when the potential difference between the developing roller 9 and the toner charging roller 20 is set to −1200 V, developing bias of −300 V is applied from the developing bias power source S1 to the developing roller 9, and charging bias of −1500 V is applied from the toner charging bias power source S2 to the toner charging roller 20. Under such bias applying conditions, the charging amount of the toner T charged by the toner charging roller 20 is made uniform to −60 μC/g and the toner is uniformly is carried to the developing portion opposed to the photosensitive drum 1. In this developing portion, the toner T formed as the thin toner layer on the developing roller 9 is adhered to the electrostatic latent image formed on the photosensitive drum 1, by means of the developing roller 9 to which the developing bias of −300 V was applied, thereby developing the latent image as the toner image.

Further, the toner which did not contribute to the developing on the developing roller 9 is stripped from the surface of the developing roller 9 in the abut portion between the developing roller and the elastic roller 10. A major part of the stripped toner is carried by the rotation of the elastic roller 10 and is mixed with the toner T within the developing container 8, with the result that the charges of the toner T are dispersed. And, at the same time, by the rotation of the elastic roller 10, new toner T is supplied onto the developing roller 9, and the above-mentioned developing operation is repeated.

Figure 7:
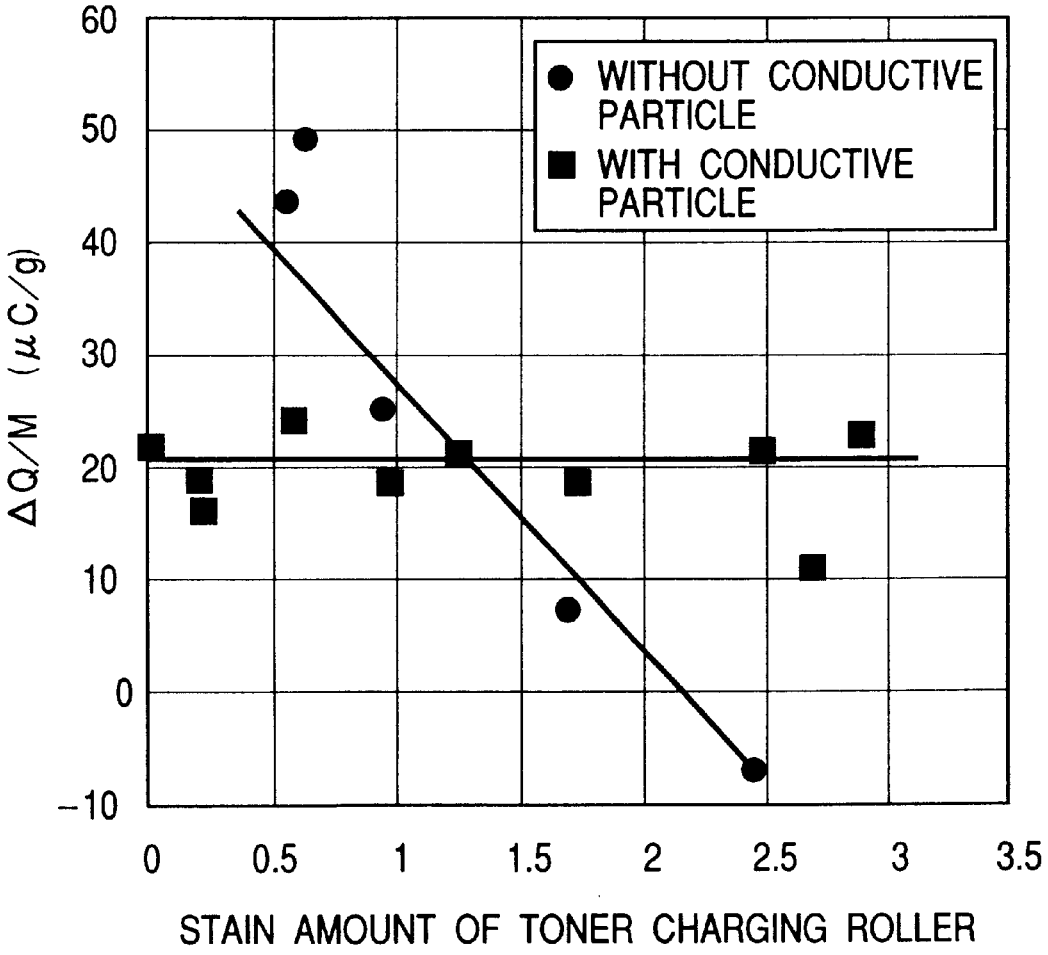
FIG. 7 is a view showing a relationship between a contamination amount of the toner charging roller and ΔQ/M.

Further, in the illustrated embodiment, as a result of examination of a relationship between a stain amount of the toner charging roller 20 and ΔQ/M (charging amount charged by the toner charging roller 20—charging amount due to only initial frictional charging) under presence/absence of externally added conductive particles, a result as shown in FIG. 7 was obtained.

As shown in FIG. 7, when the conductive particles are not externally added (black circles in FIG. 7), as the toner stain amount of the toner charging roller 20 is increased, the charge applying ability is reduced; whereas, when the conductive particles are externally added (black squares in FIG. 7), the constant charge applying ability can be maintained stably without influence of the toner stain amount of the toner charging roller 20.

Further, as a result of tests regarding an included amount of the conductive particles in the toner T, the following results were obtained.

(a) When an included amount of the conductive particles in the toner T was 2.0 parts by weight and the conductive particles had an average particle diameter of 3.0 μm and resistance of $10^3$ Ω, there was no problem regarding the charge applying ability and abnormal discharging did not occur. On the other hand, when the included amount of the conductive particles was greater than the above value or when the particle diameter of the conductive particle was greater than the above value or when the resistance of the conductive particles was smaller than the above value, abnormal discharging occurred.

(b) When the included amount of the conductive particles in the toner T was 0.1 part by weight and the conductive particles had an average particle diameter of 0.05 μm and resistance of $10^{13}$ Ω, there was no problem regarding the charge applying ability and abnormal discharging did not occur. On the other hand, when the included amount of the conductive particles was smaller than the above value or when the particle diameter of the conductive particle was smaller than the above value or when the resistance of the conductive particles was greater than the above value, the charge applying ability was decreased.

From the above test results (a) and (b), it is preferable that the included amount of the conductive particles in the toner T is 0.1 to 2.0 parts by weight and the average particle diameter of the conductive particles is 0.05 to 3.0 μm and the resistance of the conductive particles is $10^3$ to $10^{13}$ Ω. As mentioned above, the resistance of the conductive particles can be measured in the same manner as the resistance of the toner.

Further, the measurement of the average particle diameter (number average diameter) of the conductive particles are effected as follows.

That is to say, a photograph of the toner photo-taken by a scan type electronic microscope in an enlarged scale is compared with a photograph of toner mapped with elements included in conductive fine powder by means of element analyzing means such as an X-ray micro analyzer (XMA) attached to the scan type electronic microscope, and conductive fine powder adhered to or floating around the toner particle surfaces is selected by 10 to 50 numbers (pieces), longer diameters of primary particles of the selected conductive fine powders are measured, and the number average diameter can be sought from the longer diameters of 100 or more primary particles of the conductive fine powders.

Further, in the illustrated embodiment, as the conductive particles included in the toner T, while DHT-4A (manufactured by Kyowa Chemical Industry Co., Ltd.) as mentioned above was used, other than this, for example, conductive particles such as zinc oxide 23K (manufactured by Hakusui Tech. Co., Ltd.), Apatyzer (manufactured by Sangi, Inc.) or Gintec (manufactured by Kawatsuno Technical Laboratory) may be used.

In this way, in the illustrated embodiment, by including the conductive particles in the toner T, even if the toner charging roller 20 for charging the toner T on the developing roller 9 is contaminated with the toner T, since the reversal fog can be suppressed to reduce the toner consumption and the charging amount of the toner T can be maintained properly, a sharp image quality including lines and/or dots without scattering can be obtained. Further, since the toner consumption is reduced, the service life of the developing apparatus 21 can be extended and the running cost can be reduced.

Further, in the above-mentioned illustrated embodiment, while an example that the photosensitive drum 1 and the developing apparatus 21 are integrally formed as the process cartridge which can detachably be mounted to the main body of the image forming apparatus was explained, other than this, for example, the photosensitive drum 1, developing apparatus 21, charging roller 2, cleaning blade 5 and waste toner container 13 may be integrally formed as a process cartridge which can detachably be mounted to the main body of the image forming apparatus, or the developing apparatus 21 may be secured to the main body of the image forming apparatus and only the toner may be replenished.

<Second Embodiment>

Figure 8:
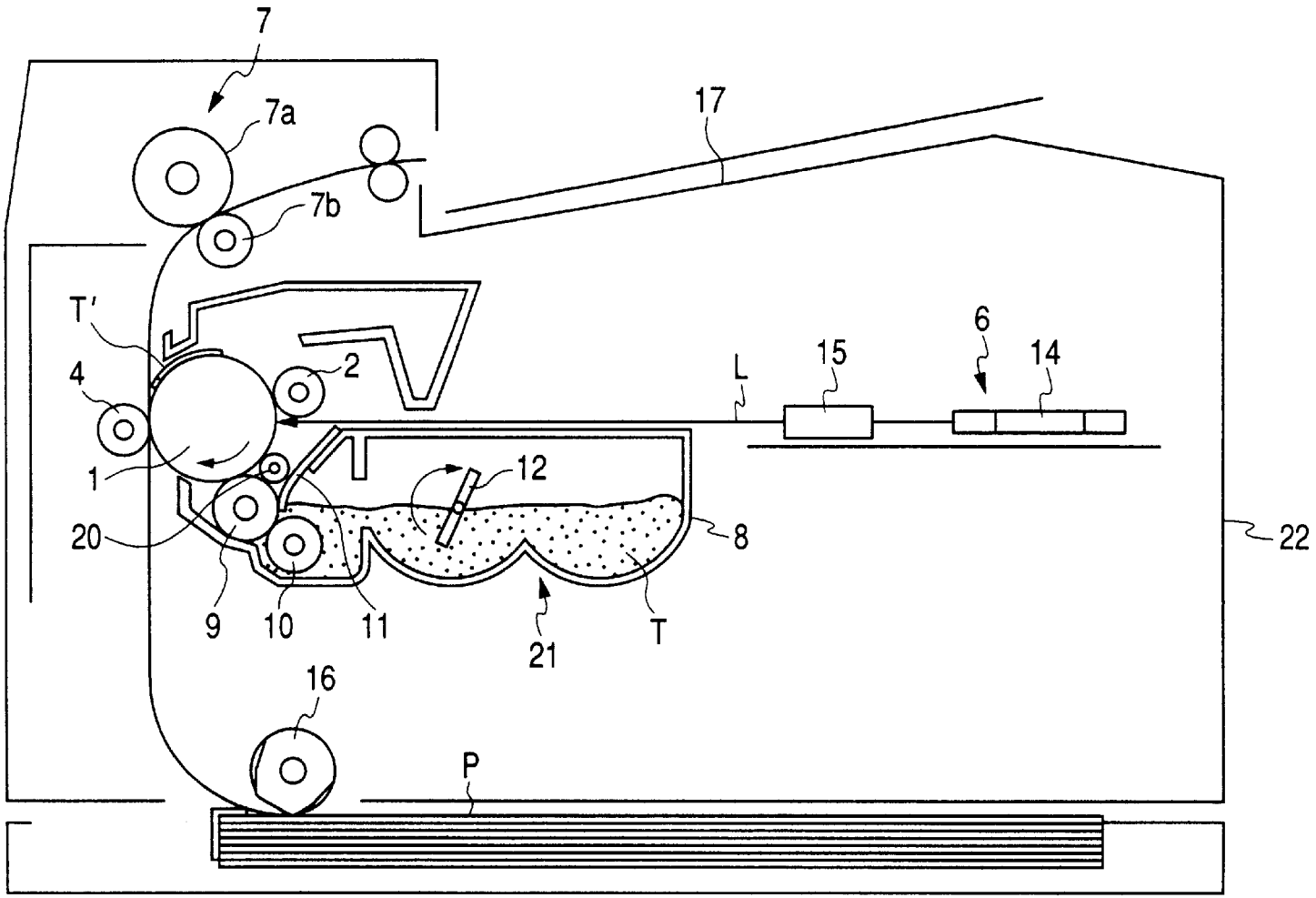
FIG. 8 is a schematic constructural view showing an image forming apparatus having a developing apparatus according to a second embodiment of the present invention.

FIG. 8 is a schematic constructural view showing an image forming apparatus having a developing apparatus according to a second embodiment of the present invention. Incidentally, the same parts as those in the image forming apparatus having the developing apparatus of the first embodiment shown in FIGS. 1 and 2 are designated by the same reference characters and a duplicated explanation will be omitted.

In the first embodiment, while an example that the residual toner remaining on the photosensitive drum 1 is removed and collected by the cleaning blade 5 was explained, in the second embodiment, in order to make the apparatus more compact, to reduce the running cost and to cope with the environmental problems, an image forming apparatus of a cleanerless type in which the cleaning blade (cleaning member) is omitted and residual toner is collected by the developing apparatus is provided. The other arrangement and the image forming operation are the same as those of the first embodiment. Also in the image forming apparatus according to the second embodiment, the combined toner similar to the first embodiment is used, and conductive particles are added externally.

Next, an operation for collecting the residual toner in the image forming apparatus according to the second embodiment will be briefly explained.

Adhered matters T' such as residual toner remaining on the photosensitive drum 1 and to be removed after the transferring are charged together with the photosensitive drum 1 by the charging roller 2 during the subsequent image formation and are made to have the same polarity as that of the drum. Then, the photosensitive drum 1 is exposed with the interposition of the adhered matters T' such as the residual toner by means of the exposing apparatus 6. As a result, image information is formed on the photosensitive drum 1 as an electrostatic latent image. In this case, if the adhered matters T' such as the residual toner is equal to or smaller than 0.1 mg/cm$^2$, disadvantage such as light block does not occur. And, the adhered matters T' such as the residual toner existing on the non-imaged portion of the photosensitive drum 1 is collected onto the developing roller 9 by the potential difference between the developing bias applied to the developing roller 9 and the potential of the dark portion on the photosensitive drum 1, and the electrostatic latent image is developed by the developing roller 9 as the toner image. The adhered matters T' such as the residual toner collected into the developing container 8 are mixed with the toner T and are re-used.

By the way, the adhered matters T' can generally be divided into the residual toner remaining after the toner image was transferred onto the transfer material P and the toner included in the reversal fog.

Figure 9:
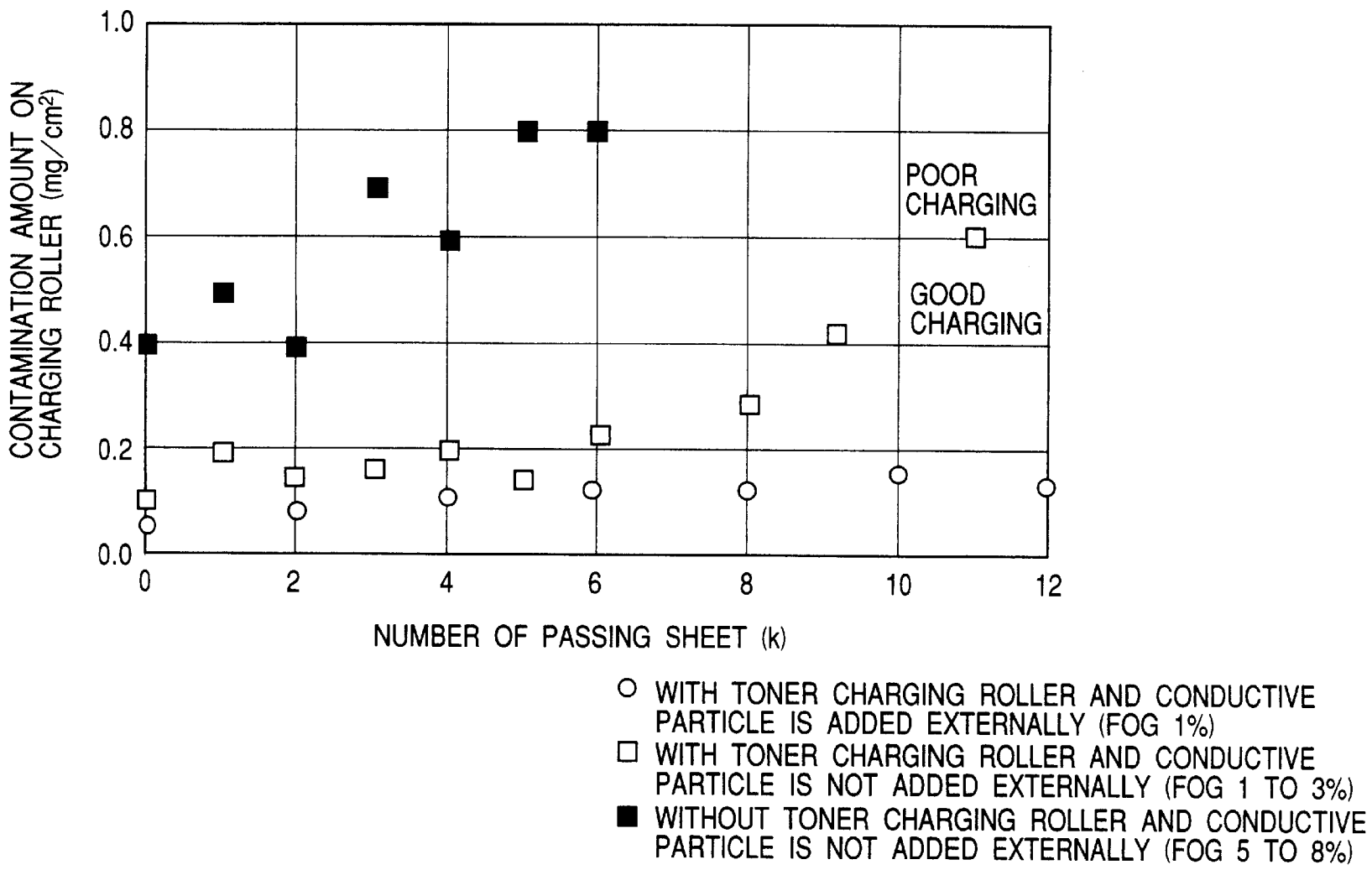
FIG. 9 is a view showing a relationship between the number of passing sheets and a contamination amount on a charging roller.

According to the Inventors' tests, as shown in FIG. 9, in case of the developing apparatus 21 according to the illustrated embodiment in which the toner charging roller 20 is provided and the conductive particles are added to the toner externally (blank or white circles in FIG. 9), as mentioned above, since the reversal fog can be substantially suppressed, the contamination of the charging roller 2 can be prevented, thereby permitting the stable charging. As a result, the charging potential for the photosensitive drum 1 can be maintained stably for a long term, and, since the charging roller 2 can make the polarity of the adhered matters T' such as the residual toner the same, almost all of the adhered matters T' such as the residual toner can be collected by the developing roller 9.

On the other hand, as a comparative example 1 for the illustrated embodiment, in a case where the toner charging roller 20 is not provided and the conductive particles are not added to the toner externally (black squares in FIG. 9), since the reversal fog becomes 5 to 8%, as the number of copied sheets is increased, the contamination of the charging roller 2 is increased, thereby causing poor charging.

Further, as a comparative example 2 for the illustrated embodiment, in a case where the toner charging roller 20 is provided and the conductive particles are not added to the toner externally (white squares in FIG. 9), in an initial stage, although the reversal fog is suppressed to 1% or less to reduce the contamination of the charging roller 2, when the number of copied sheets reaches 8000 or more, the toner will be accumulated on the toner charging roller 20 to reduce the charging applying ability, with the result that the reversal fog reaches 3%, thereby increasing the contamination of the charging roller 2. As a result, a collecting ratio of the developing roller 9 for collecting the adhered matters T' such as the residual toner is decreased.

In this way, also in the image forming apparatus of a cleanerless type according to the second embodiment, similar to the first embodiment, since the reversal fog can be suppressed to reduce the toner consumption and the charging amount of the toner T can be maintained properly, a sharp image quality including lines and/or dots without scattering can be obtained.

As mentioned above, according to the present invention, since the conductive particles are included in the developer, even if the developer charging member for charging the developer on the developer carrying body is contaminated with the developer, since the reversal fog can be suppressed to reduce the developer consumption and the charging amount of the developer can be maintained properly, a high quality image can be obtained stably for a long term.

What is claimed is:

1. A developing apparatus comprising:

a developer carrying body for carrying a developer to a developing position where an electrostatic image formed on an image bearing body is developed; and a developer charging member contacted with the developer carried by said developer carrying body and adapted to charge the developer with a voltage applied to said developer charging member;

wherein the developer includes toner and conductive particles, and wherein a resistance (Ω) of said conductive particles is smaller than a resistance (Ω) of said developer charging member.

2. A developing apparatus according to claim 1, wherein a weight of the conductive particles is in a range of 0.1 to 2.0 part by weight with respect to a weight of the toner.

3. A developing apparatus according to claim 1, wherein an average particle diameter of the conductive particles is in a range of 0.05 to 3.0 $\mu$m.

4. A developing apparatus according to claim 1, wherein the conductive particles are provided on a surface of the toner.

5. A developing apparatus according to claim 1, wherein a shape coefficient SF-1 of the toner is in a range of 100 to 180, and a shape coefficient SF-2 of the toner is in the range of 100 to 140.

6. A developing apparatus according to claim 1, wherein a charging amount of the toner is in a range of |35| to |80| $\mu$C/g.

7. A developing apparatus according to claim 1, wherein the developer is a one-component developer including non-magnetic toner.

8. A developing apparatus according to claim 1, wherein said developer charging member has a length corresponding to at least a length of an image forming area of said image bearing body in a longitudinal direction of said developer carrying body.

9. A developing apparatus according to claim 1, wherein said developer carrying body is contacted with said image bearing body in the developing position.

10. A developing apparatus according to claim 1, wherein said developer charging member is rotatable.

11. A developing apparatus according to claim 1, further comprising a regulating member for regulating a thickness of a layer of the developer carried on said developer carrying body, wherein said developer charging member is disposed at a downstream side of a regulating position of said regulating member and at an upstream side of the developing position in a developer carrying direction of said developer carrying body.

12. A developing apparatus according to claim 1, wherein the voltage has a same polarity as a normal charging polarity of the developer.

13. A developing apparatus according to claim 1, wherein the voltage has a same polarity as a polarity of a developing bias voltage applied to said developer carrying body.

14. A developing apparatus according to claim 1, wherein the voltage is equal to or greater than a discharging start voltage for the developer carried by said developer carrying body.

15. A developing apparatus according to claim 1, wherein the conductive particles are capable of adhering to said developer charging member, together with the toner.

16. A developing apparatus according to claim 1, wherein said developer carrying body is provided so as to be in contact with the image bearing body.

17. A developing apparatus according to claim 1, wherein said developer carrying body is capable of collecting a residual toner from the image bearing body.

18. A developing apparatus according to claim 1, wherein the resistance of said developer charging member is in a range of $10^3$ to $10^{11}$ (Ω).

19. A developing apparatus according to claim 1, wherein said developing apparatus is arranged in a process cartridge capable of being detachably attached to a main body of an image forming apparatus together with said image bearing body.

* * * * *

UNITED STATES PATENT AND TRADEMARK OFFICE

CERTIFICATE OF CORRECTION

PATENT NO. : 6,594,462 B2
DATED : July 15, 2003
INVENTOR(S) : Yasuyuki Ishii et al.

It is certified that error appears in the above-identified patent and that said Letters Patent is hereby corrected as shown below:

Title page,
Item [56], References Cited, FOREIGN PATENT DOCUMENTS,
"55048754 A" should read -- 55-48754 A --;
"59211050 A" should read -- 59-211050 A --;
"04101161 A" should read -- 04-101161 A --; and
"10198078 A" should read -- 10-198078 A --.

Column 1,
Line 59, "9 as" should read -- 9 (as --.

Column 8,
Line 39, "methods" should read -- method --;
Line 45, "soap free" should read -- soap-free --; and
Line 46, "methods" should read -- method --.

Column 15,
Line 17, "part" should read -- parts --.

Signed and Sealed this

Twenty-third Day of December, 2003

JAMES E. ROGAN
*Director of the United States Patent and Trademark Office*